US005552206A

United States Patent [19]

Knoke et al.

[11] Patent Number: 5,552,206

[45] Date of Patent: Sep. 3, 1996

[54] NON-WOVEN COMPOSITE INTERLINING FABRIC

[75] Inventors: Jürgen Knoke, Weinheim; Manfred Jöst, Hemsbach, both of Germany

[73] Assignee: Firma Carl Freudenberg, Weinheim, Germany

[21] Appl. No.: 388,000

[22] Filed: Feb. 13, 1995

[30] Foreign Application Priority Data

Mar. 16, 1994 [DE] Germany ..... 44 08 813.2

[51] Int. Cl.[6] ..... B32B 7/14

[52] U.S. Cl. ..... 428/102; 26/18.5; 28/104; 427/256; 428/200; 428/103; 428/198; 428/219; 428/221; 428/231

[58] Field of Search ..... 428/231, 198, 428/200, 221, 219, 102, 103; 26/18.5; 28/104; 427/256

[56] References Cited

U.S. PATENT DOCUMENTS

| | | | |
|---|---|---|---|
| 4,696,850 | 9/1987 | Jost et al. | 428/197 |
| 4,704,321 | 11/1987 | Zafiroglu | 428/230 |
| 4,737,394 | 4/1988 | Zafiroglu | 428/102 |
| 4,773,238 | 9/1988 | Zafiroglu | 66/192 |
| 4,876,128 | 10/1989 | Zafiroglu | 428/102 |
| 4,998,421 | 3/1991 | Zafiroglu | 428/102 |
| 5,075,151 | 12/1991 | Kufner et al. | 428/198 |
| 5,194,320 | 3/1993 | Groshens | 428/230 |
| 5,310,590 | 5/1994 | Tochacek et al. | 428/102 |

FOREIGN PATENT DOCUMENTS

| | | |
|---|---|---|
| 0119754 | 9/1984 | European Pat. Off. . |
| 390579 | 10/1990 | European Pat. Off. . |
| 0390579 | 11/1993 | European Pat. Off. . |
| 4116459 | 11/1992 | Germany . |

*Primary Examiner*—James C. Cannon
*Attorney, Agent, or Firm*—Kenyon & Kenyon

[57] ABSTRACT

A non-woven composite interlining fabric, which is capable of being fused on by application of an adhesive substance, contains a non-woven fabric having a mass per unit area of 10 to 40 g/m$^2$ with warp reinforcement, which warp reinforcement contains 5 to 25 g/m$^2$ textured warp yarn having a primary elongation of 10 to 35% with a total denier of 30 to 120 dtex. The weight ratio of warp yarn:non-woven fabric is from 1:3 to 3:1. The thread count is 3 to 25/inch. The composite fabric is manufactured in a warp knitting machine having a non-woven fabric feed, the non-woven fabric being reinforced with textured filaments and, at the end, the composite being thermofixed and provided with the melting adhesive. After the warp yarn is fed and prior to the thermofixing, the composite fabric is subjected to a shrinking process. The composite fabric exhibits a final elongation in the longitudinal direction of 50 to 120%.

19 Claims, No Drawings

NON-WOVEN COMPOSITE INTERLINING FABRIC

BACKGROUND OF THE INVENTION

1. Field of the Invention

The invention relates generally to a non-woven interlining fabric which is capable of being fused on using an adhesive substance, as well as to a method for manufacturing the same.

2. Description of Related Art

EP 0 390 579 B1 describes a quilt-bonded, textile fabric which has a non-woven fabric layer and spaced rows of stitches, having a row spacing of 2 to 10 cm. The quilting yarn makes up 2 to 20% of the total weight of the textile fabric. The fiber layer consists of bonded fibers, and the textile fabric has stretching capability in the stitching direction of 10 to 75%. The manufacturing method described therein includes the quilting of a non-woven fabric layer with an elastic thread, during which the thread is stretched by 10 to 100%. Rows of stitches are formed, spaced parallel to each other. After that, the tension is released and only afterwards is the shrinking treatment undertaken.

This sequence of process steps leads to a non-woven fabric which, finished as a non-woven interlining fabric which is capable of being fused on, would exhibit a disadvantageous poor surface appearance on the face fabric in the double fixing area. The poor appearance also occurs when the face fabric fixed with the non-woven interlining fabric is stretched on the bias. In addition, with the method described, light non-woven fabric weights of 10 to 40 g/m$^2$ can only be worked on a warp knitting machine with difficulty, because the tensions in the direction of the warping in connection with the non-woven fabric, which is only lightly bonded and easily destructible, can be only poorly controlled.

SUMMARY OF THE INVENTION

It is an object of this invention to specify an elastic, non-woven composite interlining fabric, capable of being fused on using an adhesive substance, which is light, has a round, flat and soft hand with perfect surface smoothness, and which is washable and unaffected by dry cleaning. It is a further object to provide a method for manufacturing this non-woven composite interlining fabric.

The object is fulfilled by a non-woven, composite interlining fabric, which is capable of being fused on by application of an adhesive substance. The composite contains a non-woven fabric having a mass per unit area of 10 to 40 g/m$^2$ with warp reinforcement, which warp reinforcement contains 5 to 25 g/m$^2$ textured warp yarn having a primary elongation of 10 to 35% with a total denier of 30 to 120 dtex. The weight ratio of warp yarn:non-woven fabric is from 1:3 to 3:1. The thread count is 3 to 25/inch. The composite fabric is manufactured in a warp knitting machine having a non-woven fabric feed, the non-woven fabric being reinforced with textured filaments and, at the end, the composite being thermofixed and provided with the melting adhesive. After the warp yarn is fed and prior to the thermofixing, the composite fabric is subjected to a shrinking process. The composite fabric exhibits a final elongation in the longitudinal direction of 50 to 120%.

DETAILED DESCRIPTION OF THE INVENTION

The non-woven composite interlining fabric is capable of being fused on by application of an adhesive substance, and contains a non-woven fabric having a weight of 10 to 40 g/m$^2$ which has an elastic warp reinforcement. This warp reinforcement contains 5 to 25 g/m$^2$ of textured warp yarn having a primary elongation of 10 to 35%, a total denier of 30 to 120 dtex and a thread count of 3 to 25/inch (1.8 to 9.84/cm). The composite fabric exhibits an elongation in the longitudinal direction of 50 to 120%. The weight ratio of warp yarn:non-woven fabric amounts to 1:3 to 3:1.

The manufacturing method for the non-woven composite interlining fabric is carried out in a warp knitting machine having a non-woven fabric feed. The non-woven fabric is reinforced with the textured warp filaments and the resulting composite is thereupon thermofixed, as well as provided with a melting adhesive. Moreover, after the warp yarn is fed, but before the thermofixing, the non-woven composite fabric is subjected to a complete tensionless shrinking process, after which, its final elongation in the longitudinal direction amounts to 50 to 120%.

It was surprising and unexpected that the non-woven fabric, initially relatively stiff because of the warp reinforcement and elastic in the relaxed state, after the shrinking process, would yield a non-woven composite interlining fabric which, after fixing onto a face fabric using melting adhesive, results in an excellent surface smoothness, even in the case of double fixation and steaming. Also, in contrast to all Prior Art warp-reinforced non-woven interlining fabrics, bias stretching reveals no poor surface appearance. This is particularly surprising because the warp yarns are relatively thick.

Before shrinking, the composite fabric exhibits an extension in length of between 15 and 35%, after shrinking, between 50 and 120%.

Warp yarns made of nylon 6 or nylon 66 proves to be particularly suitable for the invention, because these produce an especially flexible elasticity.

One obtains a particularly good final appearance using side-by-side bicomponent filaments, with nylon 6 or nylon 66 components on one hand, and polyester components on the other.

Warp yarns made of polyester are preferred if one would like to produce particularly color-stable interlining fabrics.

It is expedient to select soft non-woven fabrics as the base. Spot-heat-sealed, fiber-bonded, non-woven fabrics are preferred.

A special softness is attained when the non-woven fabric is bonded using water jets. Moreover, for obtaining an especially high internal strength, thermoplastic binding fibers can be included as well.

Alternatively, strengthening binding agents are also usable. Versions hardened in such a manner are particularly suitable for trouser waistband interlinings, which are elasticized lengthwise and are supposed to facilitate adjustment to body size.

During the manufacturing process, the shrinking process with regard to the non-woven fabric provided with warp yarn must be accomplished without tension, because, in this way, the elasticity of the composite material is best achieved.

The shrinking can be carried out using hot water; however, saturated steam is preferred, since, because of the lower moisture absorption in this case, the non-woven composite is damaged the least and, in spite of that, the shrinking process completely runs its course.

The following examples should further clarify the nature of the invention, without restricting it.

EXAMPLE 1

A fleece was placed on a machine for random laying of fibers with 100% polyamide 6 fibers and a mass per unit area (i.e., density) of 20 g/m$^2$. The fleece was bonded on a calender consisting of an engraved roller and a smooth roller at 200° C. to form a non-woven fabric. On a Raschel machine having the capability of feeding non-woven fabric, this non-woven fabric was interwoven with a textured bicomponent warp thread made of polyamide 6/polyester (side-by-side), the titer amounting to 78 dtex. The thread count was 18/inch (7.09/cm), with uniform spacing between the threads.

The composite fabric produced in this manner was treated without tension in a steam aggregate using saturated steam. In so doing, it turns out that the thread, which initially was almost inflexible, having an original extension in length of about 20%, became elastic and exhibited an elongation of 80%.

The composite material was subjected to a fixing process in a tenter frame at a temperature of 190° C. This was followed by the spot application of a copolyamide melting adhesive in a quantity of 16 g/m$^2$.

Upon fixing this material in a through-feed press at 140° C., the face fabric showed a very smooth surface, both in the case of simple fixing, as well as in the case of double fixing, before and after the steaming, without poor appearance occurring when drafting in diagonal direction (slanting-off).

EXAMPLE 2 (example demonstrating the opposite result)

The method according to Example 1 was repeated, with the difference that a non-textured polyamide 6 warp thread was used. Its elongation was about 15% in the longitudinal direction and remained unchanged when the fabric was exposed to a steaming process according to Example 1. The material was further treated in the manner described therein.

In the case of simple fixing without steaming, this composite fabric indeed showed a good surface appearance, similar to that in Example 1; however, double fixing and, above all, slanting-off caused a perceptible deterioration of the desired surface smoothness. The hand was distinctly harder and less textile.

What is claimed is:

1. A method for manufacturing a non-woven composite interlining fabric which is capable of being fused on by means of an adhesive substance, comprising the steps of: selecting a non-woven fabric having a weight of 10 to 40 g/m$^2$; reinforcing the fabric by interweaving it with textured warp yarn which has an initial elongation of 10 to 35%, the weight ratio of warp yarn to non-woven fabric being from 1:3 to 3:1, the thread count of the warp yarn being from 3 to 25/inch (1.8 to 9.84/cm); subjecting the resulting composite fabric, without tension, to a complete shrinking process up to a final elongation of 50 to 120% in the longitudinal direction; thermofixing the fabric while simultaneously smoothing its surface; and coating the fabric with melting adhesive.

2. The method according to claim 1 wherein the shrinking process is carried out using saturated steam.

3. The method according to claim 1 wherein the step of reinforcing is conducted by feeding the non-woven fabric into a warp knitting machine.

4. The method according to claim 1 wherein the warp yarn consists of nylon 6.

5. The method according to claim 1 wherein the warp yarn consists of nylon 66.

6. The method according to claim 1 wherein the warp yarn is comprised of nylon 6/polyester bicomponent filaments of the side-by-side type.

7. The method according to claim 1 wherein the warp yarn is comprised of nylon 66/polyester bicomponent filaments of the side-by-side type.

8. The method according to claim 1 wherein the warp yarn consists of polyester.

9. The method according to claim 1 wherein the non-woven fabric component is fiber-bonded and spot-heat-sealed.

10. The method according to claim 2 wherein the non-woven fabric component is fiber-bonded and spot-heat-sealed.

11. The method according to claim 3 wherein the non-woven fabric component is fiber-bonded and spot-heat-sealed.

12. The method according to claim 4 wherein the non-woven fabric component is fiber-bonded and spot-heat-sealed.

13. The method according to claim 5 wherein the non-woven fabric component is fiber-bonded and spot-heat-sealed.

14. The method according to claim 6 wherein the non-woven fabric component is fiber-bonded and spot-heat-sealed.

15. The method according claim 1 wherein the non-woven fabric component is bonded using water jets.

16. The method according to claim 15 wherein the non-woven fabric component contains a binding fiber and is thermally bonded.

17. The method according to claim 1 wherein the composite is bonded additionally with a binding agent.

18. The method according to claim 15 wherein the composite is bonded additionally with a binding agent.

19. The method according to claim 1 wherein the step of coating the fabric with adhesive is conducted by spot applying the adhesive.

* * * * *

UNITED STATES PATENT AND TRADEMARK OFFICE

CERTIFICATE OF CORRECTION

PATENT No. : 5,552,206

DATED : September 3, 1996

INVENTOR(S): KNOKE et al.

It is certified that error appears in the above-identified patent and that said Letters Patent is hereby corrected as shown below:

In column 4, line 46 (claim 17), change "claim 1" to --claim 7--.

Signed and Sealed this

Fifteenth Day of April, 1997

*Attest:*

Bruce Lehman

BRUCE LEHMAN

*Attesting Officer*

*Commissioner of Patents and Trademarks*